US011795522B2

(12) United States Patent
Teng

(10) Patent No.: US 11,795,522 B2
(45) Date of Patent: Oct. 24, 2023

(54) ALUMINUM-BASED ULTRA-THIN LAUNDER

(71) Applicant: Shenyang Hengtaixinyuan Casting Refractories Co., Ltd., Shenyang (CN)

(72) Inventor: Huanan Teng, Shenyang (CN)

(73) Assignee: Shenyang Hengtaixinyuan Casting Refractories Co., Ltd., Shenyang (CN)

( * ) Notice: Subject to any disclaimer, the term of this patent is extended or adjusted under 35 U.S.C. 154(b) by 67 days.

(21) Appl. No.: 17/026,757

(22) Filed: Sep. 21, 2020

(65) Prior Publication Data

US 2021/0095359 A1 Apr. 1, 2021

(30) Foreign Application Priority Data

Sep. 26, 2019 (CN) ..... 201910916152.9

(51) Int. Cl.
*C22B 5/02* (2006.01)

(52) U.S. Cl.
CPC ..... *C22B 5/02* (2013.01)

(58) Field of Classification Search
CPC ..... C22B 5/02; F27D 3/145; B22D 43/004
See application file for complete search history.

(56) References Cited

U.S. PATENT DOCUMENTS 1,862,787 A * 6/1932 Ennor ..... B22D 43/004 266/231
4,426,067 A * 1/1984 Hopkins ..... C21B 7/14 266/46
4,678,168 A * 7/1987 Enkner ..... F27D 3/14 266/236
2018/0354028 A1* 12/2018 Rundquist ..... C22B 9/02

FOREIGN PATENT DOCUMENTS

CN 205526168 U 8/2016

* cited by examiner

*Primary Examiner* — Scott R Kastler
(74) *Attorney, Agent, or Firm* — TROUTMAN PEPPER HAMILTON SANDERS LLP; Christopher C. Close, Jr.

(57) ABSTRACT

The present invention relates to the field of alloy-smelting facilities, and provides an aluminum-based ultra-thin launder. The launder has a body with a wall thickness of 12 mm to 25 mm. The body has a segmented structure, including a part of alloy in, a first launder, a second launder and a part of alloy out that are connected in sequence. The body of the launder provided in the present invention is lighter and thinner. The cost of production and use is reduced due to the significantly-decreased wall thickness and weight. The connection mode for components of the body is changed, which is beneficial to the replacement, and fundamentally lowers the risk of a repair material contaminating melted alloy.

11 Claims, 3 Drawing Sheets

ALUMINUM-BASED ULTRA-THIN LAUNDER

TECHNICAL FIELD

The present invention relates to alloy-smelting facilities, and in particular to an aluminum-based ultra-thin launder.

BACKGROUND

After the alloy smelting is completed in a vacuum induction furnace, since direct casting cannot meet the requirements for the purity of melted steel due to the violent boiling and vigorous stirring of steel slags in a smelting furnace, and the equipment space is limited, the melted steel must be poured into a launder first for standing and filtering, and then injected into an ingot mold.

The launder plays a role of transporting the melted alloy either in an ordinary metal-smelting process or a vacuum smelting process. A traditional launder is mainly made of clay or other refractory materials by a one-step molding process. The traditional launder exhibits the following major defects at the early stage of manufacturing: large internal stress, clamping gap, unstable structure and the like. The traditional launder is prone to crack at high temperature during use, the surface layer thereof is easy to be peeled off, the residual metal on the inner wall thereof is not easy to be cleaned, and the metal (mainly high-temperature alloy) is easy to be contaminated in the procedure for transporting the melted metal during the melting process. In addition, because the traditional launder has a single structure and is formed by a one-step molding, which results in poor quality and low thermal shock property, the quality of metals (mainly precious metals, such as high-temperature alloy) produced by smelting is affected in practical applications.

If the quality and thermal shock property of the launder need to be improved, it is necessary to increase the manufacturing cost, resulting in an unfavorable situation where the input is close to or even greater than the output. Therefore, it is in an urgent need to improve the traditional launder in the structure and process. In addition, the traditional launder cannot be used in the vacuum melting process, which has short service life and is easy to pollute the melted metal under this process.

Chinese Patent CN205526168U discloses a launder for metal smelting, including a launder body. The launder body is a layered structure obtained by bonding layer by layer from the inner wall to the outer wall of the launder body. The launder body is disposed with a refractory layer, a transition layer, a reinforcement layer and a protective layer in sequence from the inner wall to the outer wall. The patent changes the layered structure of the body of the launder to avoid the internal stress produced during the one-step molding of the traditional launder, resulting in a stronger structure with higher thermal shock property.

By changing the layered structure of the inner wall of the launder, the defects in internal stress and thermal shock property of the launder are alleviated to a certain extent, making the resulting launder suitable for most alloy-smelting processes. However, during a high-temperature cobalt-chromium-nickel-based alloy smelting process, as the casting temperature is 1,450° C. to 1,570° C., the casting needs to be conducted for about 20 min or more. In actual use, after being flushed by melted cobalt-chromium-nickel-based alloy with high temperature, the launder will locally deform slightly, which will aggravate the internal stress in the launder. After being used for several times, the launder will crack and have to be repaired or replaced.

Moreover, because the above-mentioned launder is made by one-step molding, the overall structure thereof cannot be disassembled, which is bulky and relatively-complicated. In a case where the product cracks and can be repaired, as the repair material is added later and is not tightly bonded to the launder body, contamination is easy to be cause by the repair material falling off under the flushing of the melted alloy, which will compromise the quality of the melted steel. In a case where the product cracks and cannot be repaired, the entire launder needs to be replaced, where, a large number of raw materials will be consumed, causing waste; it takes a long time to clean the new product to be used; and it takes more manpower and material resources to replace a set of launder, which greatly reduces the working efficiency of the smelting process.

SUMMARY

In view of this, the present invention is intended to provide an aluminum-based ultra-thin launder, where an integrally-formed launder is split into a plurality of partial components, which improves the yield for preparing the components of a launder, and during the repairing process of the launder, enables the separate replacement for each segment, the reduction of manpower and material resources, and the improvement of work efficiency. Furthermore, through the segmented structure, the thickness of the launder body is greatly reduced while the internal stress in the launder body is eliminated.

In order to realize the objective of the present invention, the present invention provides the following technical solutions.

The present invention provides an aluminum-based ultra-thin launder. The launder has a body with a wall thickness of 12 mm to 15 mm; and the body has a segmented structure, including a part of alloy in, a first launder, a second launder and a part of alloy out that are connected in sequence.

Preferably, the part of alloy in, the first launder, the second launder and the part of alloy out are connected via splicing or snapping connection.

Preferably, the part of alloy in includes a buffer zone and a direct-flow zone; and the buffer zone and the direct-flow zone are connected via a ramp.

Preferably, an engaging groove is disposed in the direct-flow zone, and a filter plate is disposed in the engaging groove.

Preferably, a slag-blocking device is disposed on one side of the bottom of the engaging groove.

Preferably, one end of the part of alloy out is closed, and the closed-end of the part of alloy out has an inclined surface.

Preferably, the body of the launder has a bottom with an arc-shaped structure.

Preferably, the body of the launder has a layered structure disposed with a refractory layer, a transition layer, a reinforcement layer and a protective layer in sequence from the inside to the outside; and the layered structure is prepared by coating.

Preferably, the refractory layer has a thickness of 3 mm to 5 mm; the transition layer has a thickness of 2 mm; the reinforcement layer has a thickness of 5 mm to 15 mm; and the protective layer has a thickness of 2 mm to 3 mm.

Preferably, the refractory layer is made of white corundum, and the white corundum has a spherical or laminated structure.

Beneficial Effects:

The present invention provides an aluminum-based ultra-thin launder. The launder has a body with a thickness of 12 mm to 25 mm; and the body has a segmented structure, including a part of alloy in, a first launder, a second launder and a part of alloy out that are connected in sequence. In the present invention, by changing the connection mode for the launder, the original integrally-formed launder is changed to a segmented structure, which has the following advantages:

1) Since the launder has a segmented structure, during the production of a launder, the yield for components of a segmented launder is higher than that for an integrally-formed launder.

2) The original launder is an integrally-formed elongated structure, which exhibits an increased internal stress and is easier to break with the increase of the aspect ratio. Although the improvement of the layered structure of a launder body can reduce the internal stress, the internal stress in the launder body will gradually increase as the volume and length of the industrial launder increase. In order to avoid the occurrence of cracking of the launder during a large-scale production process, a conventional method in the art is to set the thickness of the launder body to more than 50 mm, but the increase in wall thickness will cause the increase in the volume of the launder, resulting in larger production cost and inconvenient transportation. However, the present invention adopts the method of segmenting the launder and the technical idea of dividing the launder body to eliminate the excessive internal stress caused by too-high aspect ratio, which avoids the occurrence of cracking of the launder during use, and reduce the thickness of the launder body, thereby meeting the requirements for a light and thin launder body for the launder in industrial production.

3) During a replacement process for the launder, one of the components can be replaced in a targeted manner, which reduces the time and labor intensity required in the repair process for the launder, and enables that the components of the aluminum-based ultra-thin launder can be repeatedly replaced and used, with reduced repair times. Compared with the repair method, the replacement of components eliminates the possibility of alloy being contaminated by a repair material, improves the purity and process stability for the alloy-smelting, and indirectly improves the qualification rate and service life of products in the subsequent procedure.

4) The launder provided in the present invention is relatively-thin, requires relatively-convenient installation for use, and exhibits no cracking when being used at high temperature. Moreover, the launder can be used for a long time at high temperature without cracking and peeling conditions on the surface.

DETAILED DESCRIPTION

The technical solutions in the examples of the present invention are clearly and completely described below with reference to the accompanying drawings in the examples of the present invention. Apparently, the described examples are merely a part rather than all of the examples of the present invention. All other examples obtained by a person of ordinary skill in the art based on the examples of the present invention without creative efforts shall fall within the protection scope of the present invention.

Figure 1:
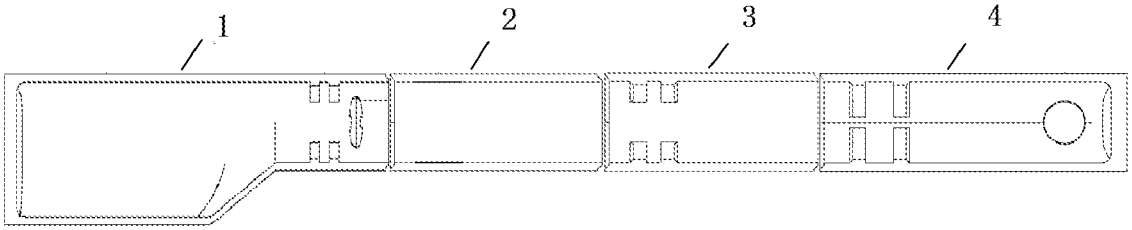
FIG. 1 is a schematic diagram of the planar structure of the aluminum-based ultra-thin launder of the present invention, where, 1 represents part of alloy in, 2 represents a first launder, 3 represents a second launder, and 4 represents a part of alloy out.

The present invention provides an aluminum-based ultra-thin launder, with a structure shown in FIG. 1. The launder has a body with a wall thickness of 12 mm to 25 mm; and the body has a segmented structure, including a part of alloy in 1, a first launder 2, a second launder 3 and a part of alloy out 4 that are connected in sequence. The present invention has no special limitation on the dimensions of the part of alloy in 1, the first launder 2, the second launder 3 and the part of alloy out 4, which can be adjusted to adapt to the industrial production.

The body of the launder provided in the present invention has a thickness of 12 mm to 25 mm, and preferably of 20 mm to 25 mm. In the present invention, the aluminum-based ultra-thin launder has a wall thickness only about ⅓ of that of an integrally-formed aluminum-based launder. During the industrial production process, it is dedicated to reducing the volume and weight of the launder as much as possible on the basis of no cracking at high temperature, and in addition to changing the material, reducing the wall thickness is the best option. The present invention, by designing the body of the launder as a segmented structure, reduces the wall thickness of the body and eliminates the defect that the body is prone to crack under excessive internal stress, which meets the need for light, thin and portable smelting facilities in industrial production.

Figure 2:
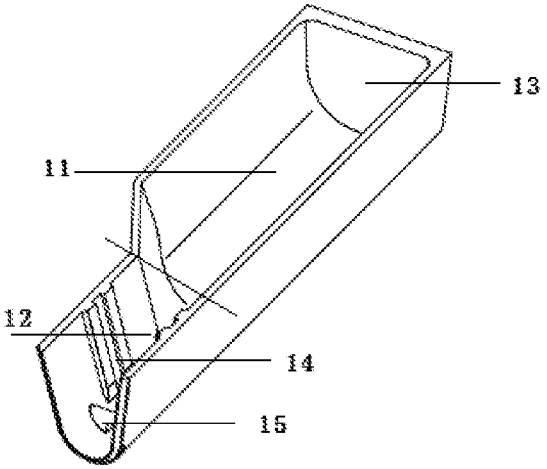
FIG. 2 is a three-dimensional structure diagram of the part of alloy in, where, 11 represents a buffer zone, 12 represents a direct-flow zone, 13 represents a closed end surface of the part of alloy in, 14 represents an engaging groove, and 15 represents a slag-blocking device.

In the present invention, the part of alloy in 1 has a structure shown in FIG. 2, including a buffer zone 11 and a direct-flow zone 12. The buffer zone 11 and the direct-flow zone 12 are connected via a ramp (see FIG. 2), and the buffer zone 11 has an area larger than that of the direct-flow zone 12, so as to alleviate the sputtering occurred when melted alloy is poured. In the present invention, one end of the buffer zone 11 is closed, and the closed end surface 13 is an irregular and smooth inclined surface, which has an angle of inclination with the bottom surface of the launder body, preferably of 100° to 120°. Since the closed end surface 13 of the present invention is an inclined surface, when melted alloy is poured into the launder, the sputtering of the liquid can be effectively avoided due to the angle of inclination. In the present invention, the top cross section of the buffer zone 11 is a trapezoid, and the upper plane of the trapezoid has an included angle preferably of 120° to 150°.

Figure 7:
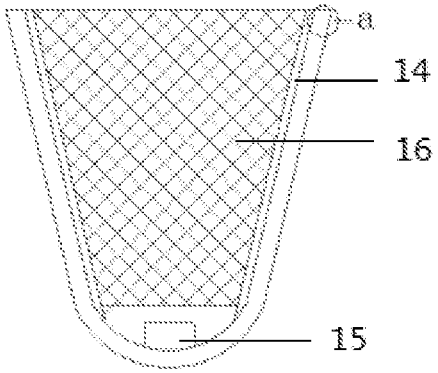
FIG. 7 is a left view of the direct-flow zone 12 in FIG. 2, where, 14 represents an engaging groove, 15 represents a slag-blocking device, and 16 represents a filter plate.

In the present invention, an engaging groove 14 and a slag-blocking device 15 are disposed in the direct-flow zone 12. In the present invention, the engaging groove 14 includes a left engaging groove and a right engaging groove, which are disposed on two sides of the inner wall of the groove, respectively, and there is a gap at the intersection of the left and right engaging grooves to facilitate the flow of melted alloy at the bottom. A filter plate 16 is disposed in engaging groove 14, and the filter plate 16 has a structure shown in FIG. 7. The filter plate 16 can block the slags in melted alloy when the melted alloy flows through the direct-flow zone, and thus prevents the slags from flowing to the subsequent processes. In the present invention, the slag-blocking device 15 is disposed on one side of the bottom of the engaging groove 14. As there is a gap at the bottom of the engaging groove 14, part of the deposited large-particle slags may flow through the gap. Therefore, the slag-blocking device 15 is disposed to further block the slags.

Figure 3:
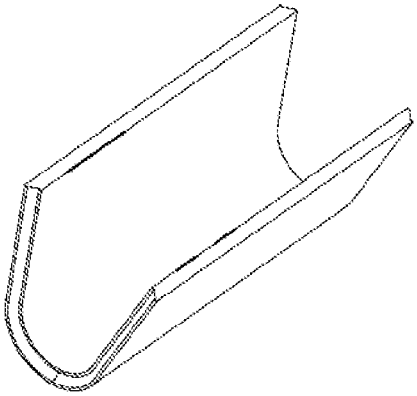
FIG. 3 is a three-dimensional structure diagram of the first launder.
Figure 4:
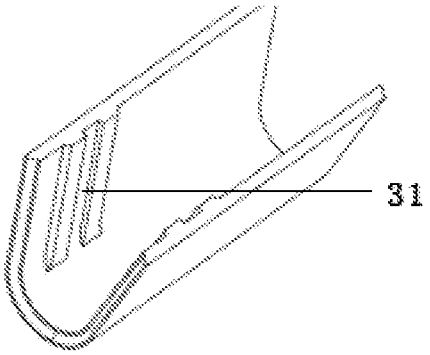
FIG. 4 is a three-dimensional structure diagram of the second launder, where, 31 represents an engaging groove.

In the present invention, the first launder 2 has a structure shown in FIG. 3, and the second launder 3 has a structure shown in FIG. 4. In the present invention, the first launder 2 and the second launder 3 have the same length, width and span. During a specific implementation of the present invention, the first launder and the second launder have a span independently of 120 mm, a height independently of 25 mm, and a wall thickness independently of 25 mm. In the present invention, an engaging groove 31 is disposed in the second launder 3. In an embodiment of the present invention, a filter plate is disposed in the engaging groove 31. In another embodiment of the present invention, a restrictor plate is disposed in the engaging groove 31. The restrictor plate includes an upper blocking plate and a lower filter plate. The restrictor plate is disposed to gather the slags that are not blocked in the previous process in the upper area of the second launder, which enables the unified cleaning, the multi-blocking, and the deep purification of the melted alloy.

Figure 5:
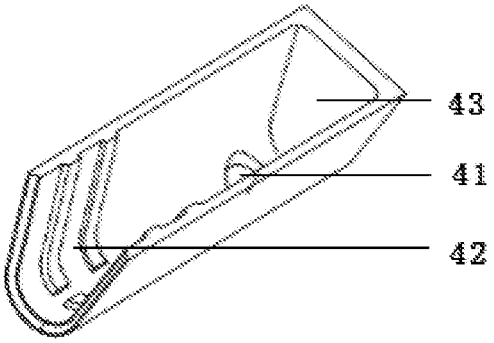
FIG. 5 is a three-dimensional structure diagram of the part of alloy out, where, 41 represents a steel-discharging port, 42 represents an engaging groove, and 43 represents a closed end surface of the part of alloy out.

In the present invention, the part of alloy out 4 has a structure shown in FIG. 5, one end of the part of alloy out 4 is closed, and the closed end surface 43 is an inclined surface, with an angle of inclination preferably of 100° to 150°. In the present invention, a steel-runner port 41 and an engaging groove 42 are disposed in sequence on the left side of the closed end surface 43.

In the present invention, the part of alloy in 1, the first launder 2, the second launder 3 and the part of alloy out 4 are preferably connected via splicing or snapping connection.

In the present invention, when the connection mode is splicing connection, the splicing surface among components 1 to 4 of the launder is a smooth surface, and has an angle preferably of 45°/135°. In an embodiment of the present invention, the spliced launder is preferably used in combination with a supporting thermostable housing. The thermostable housing is wrapped around the launder. The spliced launder is fastened by the housing to compensate for the poor stability of the spliced launder, thereby avoiding the outflow of melted alloy. In another embodiment of the present invention, the spliced launder is preferably sealed from the outside using thermostable mud to improve the stability of the launder. The present invention has no special limitation on the material of the thermostable housing and the thermostable glue, and conventional thermostable materials and thermostable mud (resisting a temperature greater than the melting temperature of melted alloy) in the art may be used.

Figure 6:
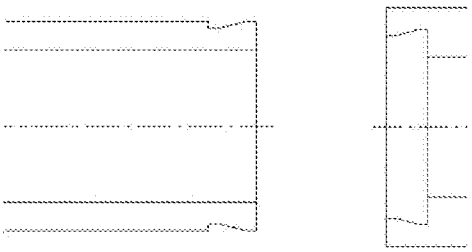
FIG. 6 is a schematic diagram of the snapping connection for the aluminum-based ultra-thin launder of the present invention.

In the present invention, when the connection mode is snapping connection, the present invention preferably adopts a snapping structure shown in FIG. 6 for connection. In an embodiment of the present invention, taking the first and second launders as examples, when one end surface of the first launder 2 is convex, the end surface of the second launder 3 connected thereto is concave, and the angle of inclination in the recess is preferably of 10° to 30°. If the angle of inclination in the recess is too large, the protrusion has a longer external extension, and fracturing tends to occur at sharp corners when the launder is assembled. Therefore, the arrangement of small angles can effectively avoid the external extension of the protrusion, and thus reduce the possibility of fracturing at the sharp corners.

In the present invention, the bottom of the body of the launder preferably has an arc-shaped structure, which is lighter than that disclosed in Chinese patent CN205526168U, and is not prone to break due to no edges and corners. Moreover, the present invention adopts a segmented structure. Compared with a T-shaped structure, the arc-shaped structure exhibits an internal stress that is eliminated to a certain extent, and the launder body will not crack when being used at high temperature.

Figure 8:
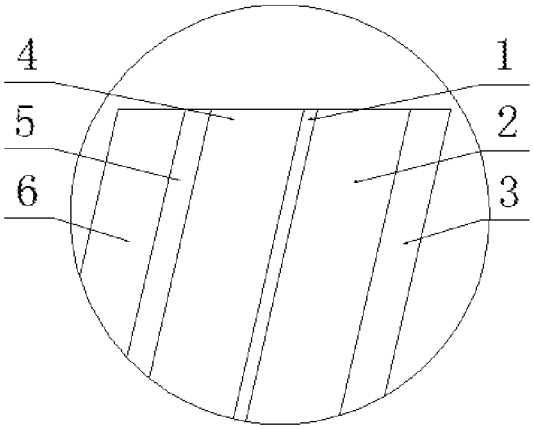
FIG. 8 is an enlarged partial view of part a of the side wall of the launder body in FIG. 7.

In the present invention, as shown in FIG. 8, the body of the launder has a layered structure disposed with a refractory layer 6, a transition layer 5, a reinforcement layer and a protective layer 3 in sequence from the inside to the outside. The reinforcement layer includes a first reinforcement layer 2, a second reinforcement layer 4, and a metal mesh 1 disposed between the first and second reinforcement layers; and the first reinforcement layer 2 and the second reinforcement layer 4 are symmetrical with respect to the metal mesh.

In the present invention, the layered structure is prepared by coating. In the present invention, the layers are prepared by coating. The material for each layer is made into a slurry in advance, and then added with a thermostable and refractory aluminum oxide material having a smaller particle size to obtain the raw material for each layer. Depending on the requirements for thickness, the refractory layer, the transition layer, the reinforcement layer and the protective layer are continuously and repeatedly coated and dried (that is, the next layer is coated after the last layer is dried). Since the layered structure formed by coating is more compact, and the stress transformation point can be further broken through after the high-temperature sintering is conducted, the stress in each layered structure can be basically compensated and released. Owing to the layer-by-layer bonding method, even if the thickness of the reinforcement layer is reduced, the stratification and fracture does not tend to occur at high temperature.

In the present invention, the refractory layer has a thickness preferably of 3 mm to 5 mm; the transition layer has a thickness preferably of 2 mm; the reinforcement layer has a thickness preferably of 5 mm to 15 mm; and the protective layer has a thickness preferably of 2 mm to 3 mm. The first reinforcement layer and the second reinforcement layer have the same thickness, preferably of 2 mm to 7 mm independently; the metal mesh 1 has a thickness preferably of 1 mm; and the first reinforcement layer 2 and the second reinforcement layer 4 are preferably bonded to the metal mesh 1 using silica sol.

In the present invention, the refractory layer 6 preferably adopts white corundum, and the white corundum preferably has a spherical or laminated structure; the transition layer 5 and the protective layer 3 preferably adopt a refractory oxide material independently; the first reinforcement layer 2 and the second reinforcement layer 4 preferably adopt heavy clay independently. The white corundum used for the refractory layer of the present invention can not only improve the refractory performance, but also can withstand the flushing of melted alloy steel due to the excellent thermal shock-resistance of white corundum. Due to the material properties and preparation process, the expansion stress after heat exposure is reduced, which can reduce the partial internal stress in the launder body, and thus can reduce the reinforcement layers. In case where the thickness of the launder body is reduced, cracking will not occur.

Example 1

An aluminum-based ultra-thin launder: The body of the launder has a segmented structure, including a part of alloy in 1, a first launder 2, a second launder 3 and a part of alloy out 4 that are connected in sequence. The components of the launder are connected via 45°/135° smooth surfaces. The launder body has a layered structure from the inner wall to the outside, and specifically, the layered structure shown in FIG. 8. From the inner wall of the launder to the outside, there are a refractory layer 6, a transition layer 5, a second reinforcement layer 4, a metal mesh 1, a first reinforcement layer 2 and a protective layer 3 in sequence. The above-mentioned layered structure is prepared by coating. The refractory layer 6, the transition layer 5, the reinforcement layers and the protective layer 3 are all made of a refractory material. The refractory layer 6 is made of spherical or laminated white corundum; the transition layer 5 and the protective layer 3 are made of a refractory oxide material; the reinforcement layers are made of heavy clay; and the metal mesh is made of copper metal. The refractory layer 6 has a thickness of 5 mm; the transition layer 5 has a thickness of 2 mm, the reinforcement layer has a thickness of 15 mm (the first reinforcement layer has a thickness of 7 mm+the metal mesh has a thickness of 1 mm+the second reinforcement layer has a thickness of 7 mm); and the protective layer 3 has a thickness of 3 mm.

Example 2

An aluminum-based ultra-thin launder: The body of the launder has a segmented structure, including a part of alloy in 1, a first launder 2, a second launder 3 and a part of alloy out 4 that are connected in sequence. The components of the launder are connected via the snapping manner shown in FIG. 6. The launder body has a layered structure from the inner wall to the outside, and specifically, the layered structure shown in FIG. 8. From the inside to the outside, there are a refractory layer 6, a transition layer 5, a second reinforcement layer 4, a metal mesh 1, a first reinforcement layer 2 and a protective layer 3 in sequence. The above-mentioned layered structure is prepared by coating. The refractory layer 6, the transition layer 5, the reinforcement layers and the protective layer 3 are all made of a refractory material. The refractory layer 6 is made of spherical or laminated white corundum; the transition layer 5 and the protective layer 3 are made of a refractory oxide material; the reinforcement layers are made of heavy clay; and the metal mesh is made of copper metal. The refractory layer 6 has a thickness of 5 mm; the transition layer 6 has a thickness of 2 mm, the reinforcement layer has a thickness of 15 mm (the first reinforcement layer has a thickness of 7 mm+the metal mesh has a thickness of 1 mm+the second reinforcement layer has a thickness of 7 mm); and the protective layer 3 has a thickness of 3 mm.

Comparative Example 1

This comparative example is different from Example 1 mainly in that the aluminum-based ultra-thin launder was integrally formed instead of a segmented structure.

The results of the specification and property tests for the launder prepared in Example 1 of the present invention are as follows:

| Properties | Flexural strength (MPa) | Compressive strength (MPa) | Thermal conductivity at room temperature (W/m · K) | Density (g/cm$^3$) | Porosity |
|---|---|---|---|---|---|
| Example 1 | 7.37 | 17 | 0.48873 | 2.2 | 17.35% |

Example 3

The casting experiment was conducted with the aluminum-based ultra-thin launder products produced in Example 1 and Comparative Example 1:

Casting amount: 4,000 kg of melted cobalt-chromium-nickel-based alloy steel at high temperature Casting temperature: 1,450° C. to 1,570° C., and Casting time: 20 min Casting Process:

1) The components of the launder were preheated for 8 h to 10 h at a preheating temperature≥1,000° C., and then the launder was assembled as shown in FIG. 1; and 2) More than 4,000 kg of melted cobalt-chromium-nickel-based alloy steel at high temperature was poured into the assembled launder, and then sent to the casting process through the launder.

Experimental results: It was found from observation that during a one-time process from use to the end, the launder product in Example 1 showed no cracking, peeling, chipping and slagging conditions, and withstood the flushing; and the first launder area exhibited an excellent slag-blocking effect, which could effectively improve the purity of the melted alloy, increase the yield of products downstream, comprehensively improve the physical and chemical parameters of the product, and increase the recovery rate of residual steel.

Recycling Experiment:

After being recycled for 3 times, the integrally-formed launder of Comparative Example 1 cracked first, while the launder of Example 1 had no obvious cracks.

After being recycled for 7 times, the launder in Example 1 cracked, and the launder in Comparative Example 1 was repaired for further use.

After being recycled for 15 times, the part of alloy in in Example 1 needed to be replaced; and the launder in Comparative Example 1 showed more cracks, and in order to ensure the purity of the melted alloy, the launder was no longer repaired for use.

Specific examples are used herein for illustration of the principles and implementations of the present invention. The description of the examples is used to help understand the method and its core principles of the present invention. In addition, those skilled in the art can make various modifications to specific implementations and application scope in accordance with the teachings of the present invention. In conclusion, the content of this specification shall not be construed as a limitation to the present invention.

What is claimed is:

1. An ultra-thin launder, comprising a body and the body has segments each having a wall thickness of 12 mm to 25 mm, wherein the segments comprise a launder inlet, a first launder, a second launder and a launder outlet that are connected in sequence; the launder inlet comprises a buffer zone and a direct-flow zone, an engaging groove is disposed in the direct-flow zone, and a filter plate is disposed in the engaging groove;

wherein, the body of the launder has a layered structure disposed with a refractory layer, a transition layer, a reinforcement layer and a protective layer in sequence from inside to outside; and the layered structure is prepared by coating.

2. The ultra-thin launder according to claim 1, wherein the launder inlet, the first launder, the second launder and the launder outlet are connected via splicing or snapping connection.

3. The ultra-thin launder according to claim 1, wherein, the buffer zone and the direct-flow zone are connected via a ramp.

4. The ultra-thin launder according to claim 3, wherein a slag-blocking device is disposed on one side of a bottom of the engaging groove.

5. The ultra-thin launder according to claim 1, wherein, one end of the launder outlet is closed, and a closed-end of the launder outlet has an inclined surface.

6. The ultra-thin launder according to claim 2, wherein, one end of the launder outlet is closed, and a closed-end of the launder outlet has an inclined surface.

7. The ultra-thin launder according to claim 1, wherein the body of the launder has a bottom with an arc-shaped structure.

8. The ultra-thin launder according to claim 2, wherein the body of the launder has a bottom with an arc-shaped structure.

9. The ultra-thin launder according to claim 1, wherein, the refractory layer has a thickness of 3 mm to 5 mm; the transition layer has a thickness of 2 mm; the reinforcement layer has a thickness of 5 mm to 15 mm; and the protective layer has a thickness of 2 mm to 3 mm.

10. The ultra-thin launder according to claim 1, wherein the refractory layer is made of white corundum, and the white corundum has a spherical or laminated structure.

11. The ultra-thin launder according to claim 9, wherein the refractory layer is made of white corundum, and the white corundum has a spherical or laminated structure.

* * * * *